United States Patent [19]

Meumann et al.

[11] Patent Number: 4,840,131

[45] Date of Patent: Jun. 20, 1989

[54] INSULATING LININGS FOR FURNACES AND KILNS

[75] Inventors: Henry R. Meumann, Lichfield, United Kingdom; Johannes Stark, Mechernich, Fed. Rep. of Germany

[73] Assignee: Foseco International Limited, Nechells, Great Britain

[21] Appl. No.: 93,942

[22] Filed: Sep. 8, 1987

[30] Foreign Application Priority Data

Sep. 13, 1986 [GB] United Kingdom ..... 8622114
Aug. 3, 1987 [GB] United Kingdom ..... 8718286

[51] Int. Cl.[4] ..... F23M 5/00

[52] U.S. Cl. ..... 110/336; 110/250; 110/332

[58] Field of Search ..... 110/250, 331, 332, 336, 110/338, 339, 340, 324, 325

[56] References Cited

U.S. PATENT DOCUMENTS

| | | | |
|---|---|---|---|
| 2,155,165 | 4/1939 | Heuer | 110/332 |
| 2,463,217 | 3/1949 | Tonneson | 110/336 X |
| 2,634,694 | 4/1953 | Hazen | 110/331 |
| 2,985,442 | 5/1961 | Hilber | 110/331 X |
| 4,246,852 | 1/1981 | Werych | 110/336 |

FOREIGN PATENT DOCUMENTS

| | | | |
|---|---|---|---|
| 728726 | 4/1955 | United Kingdom | 110/332 |
| 933994 | 8/1963 | United Kingdom . | |
| 1257699 | 12/1971 | United Kingdom . | |

*Primary Examiner*—Edward G. Favors
*Attorney, Agent, or Firm*—Nixon & Vanderhye

[57] ABSTRACT

A furnace of kiln for use in the heat treatment of materials or articles has an inner lining comprising boards of refractory, heat-insulating material restrained from inward movement by rails of refractory, heat-insulating material having shoulders at their inward side against the back of which shoulders edge portions of the boards rest.

8 Claims, 4 Drawing Sheets

Figure 4:
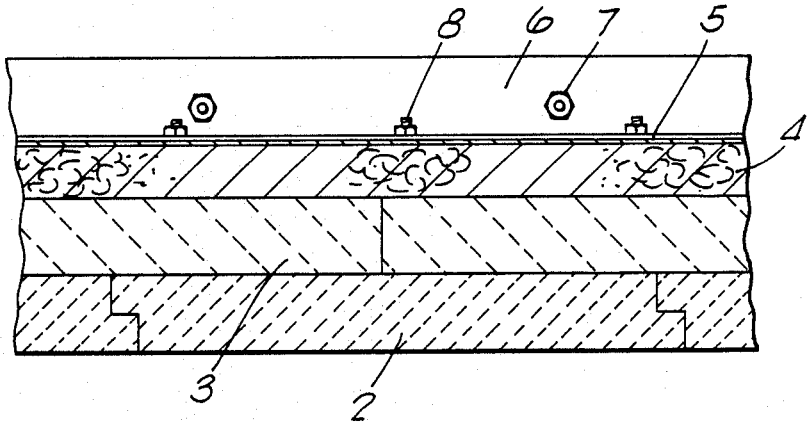

Fig. 1.
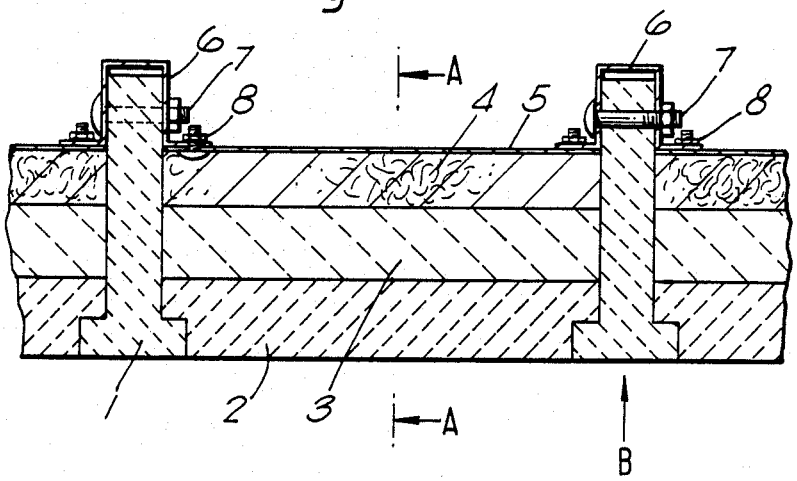
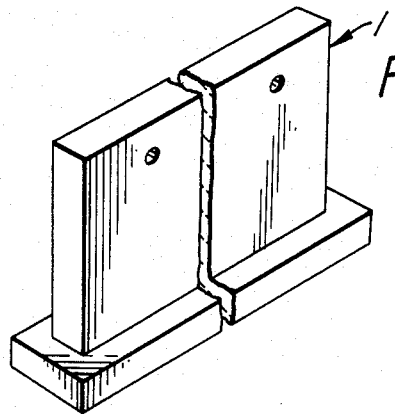
Fig. 2.
Fig. 3.
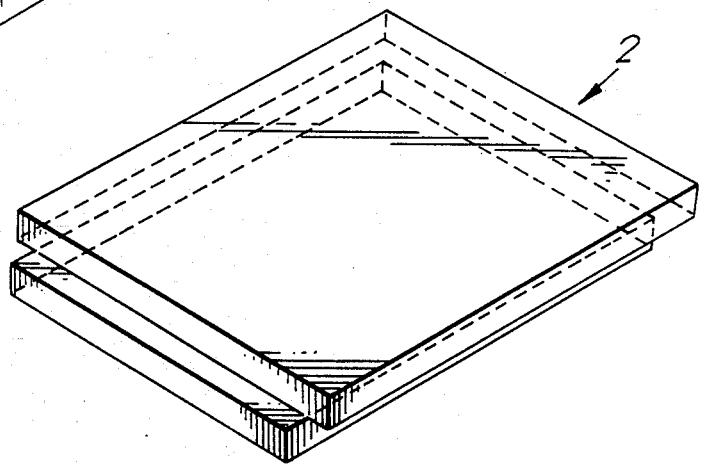

Fig. 9.
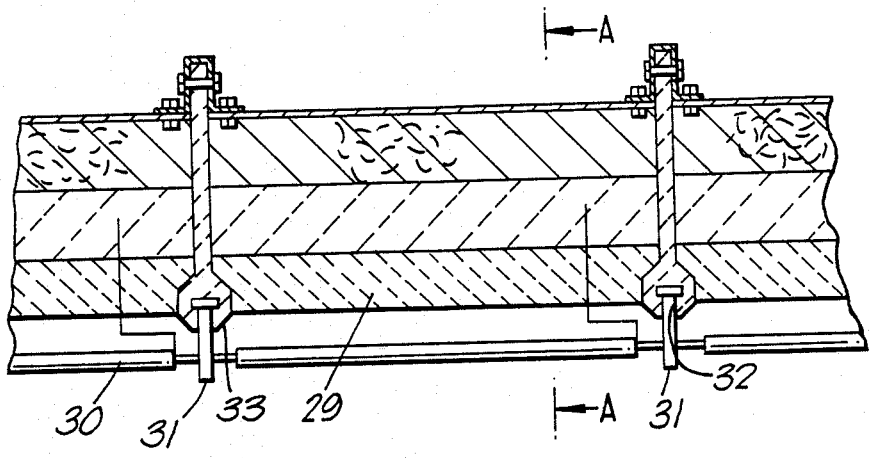
Fig. 10.
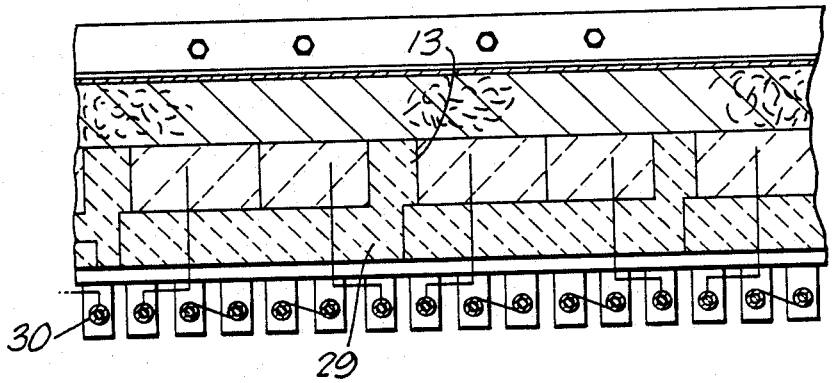
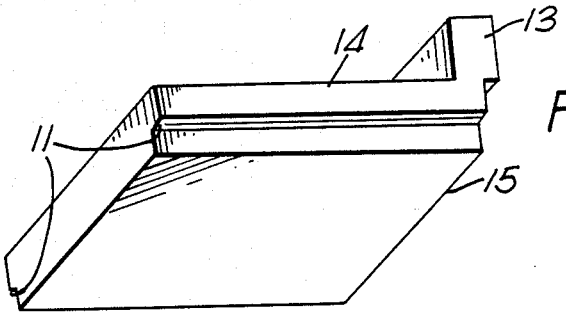
Fig. 11.

INSULATING LININGS FOR FURNACES AND KILNS

The invention concerns furnaces and kilns for heat treatment of materials and articles.

The walls and roof of low thermal mass furnaces and kilns are provided with an insulating inner lining comprising blocks, panels or similar articles of heat-insulating materials. The blocks etc. have to be restrained from sideways or downward movement into the interior of the furnace or kiln. Numerous proposals have been made for restraining the blocks etc. but none of these is entirely satisfactory. Adhesives for example tend to hold the blocks etc. insufficiently securely, particularly after prolonged exposure to high temperatures. Pins, clips and similar holding devices are somewhat subject to deterioration in use and materials of adequate strength are generally of quite high thermal conductivity so the pins etc. have the disadvantage of providing conductive paths through the insulating lining.

According to the invention a furnace or kiln for the heat treatment of materials or articles has an inner lining comprising boards of refractory, heat-insulating material restrained from inward movement by rails of refractory, heat-insulating material having shoulders at their inward side against the back of which shoulders edge portions of the boards rest.

The boards are preferably of thermal conductivity no higher than 0.1 $w.M^{-1}.°K^{-1}$ at room temperature although the conductivity may be up to 0.3 $w.M^{-1}.°K^{-1}$ at 1300° C. The conductivity at ambient temperature may be as low as 0.05 $w.M^{-1}.°K^{-1}$.

The density of the boards is desirably in the range 0.2 to 0.75 $g.cm^{-3}$ more preferably 0.3 to 0.4 $g.cm^{-3}$.

The boards are preferably of ceramic fibre-based refractory, heat-insulating material. A wide range of ceramic fibres may be used but examples of particularly suitable ceramic fibres are alumina fibres, alumino-silicate fibres containing alumina, silica and in some instances a minor proportion of zirconia. The fibres are preferably bound together by an alumina or silica binder but other inorganic binders may be used and organic binders may be used in addition to enhance handling strength.

The lining boards preferably have lapped edges to reduce the risk of heat loss at the joints between adjacent boards. These edges are also useful for compensating for any shrinkage of the boards which may occur during use. The boards may have a rib extending along an edge of a major face which rib in use spaces each board comprising the lining a predetermined and substantially constant distance away from that part of the furnace immediately remote from the inner lining boards. This aspect of lining boards according to the invention is particularly beneficial in respect of electrically heated furnaces or kilns since it facilitates the making and effectiveness of the plurality electrical connections associated with such furnaces or kilns. This is particularly the case having regard for the fact that the electrical connections in furnaces or kilns are relatively inflexible.

The rails may be of the same type of material as the boards and may have thermal conductivities and densities as discussed above. However, for optimum mechanical strength of the rails, in any particular case it may be desirable for the rails to be of somewhat higher density than the boards if the rails and boards are made from the same ingredients, in the same or different proportions.

The rails having the shoulders enable the boards to be very effectively restrained from inward movement—either sideways in the case of a wall or downwards in the case of a roof—and yet do not impair the heat-insulating character of the lining. Moreover the nature of the lining enables it to be assembled quickly and easily.

The lining may be present at one or more walls of the furnace or kiln and/or at the roof. Behind the lining there may be one or more e.g. three further layers of heat-insulating material but these need not be as refractory as the inner lining, which is exposed to the highest temperature.

The shoulders of the rails may be provided by the rails being of generally 'T'-shaped cross-section. More preferably however, the shoulders of the rails are generally bevelled. The bevelled shoulder being such that an obtuse angle is formed, which angle, when measured for example betwen an edge of a longitudinal portion of the rail and the bevel, is in the range from about 95° to about 160°. Preferably, the obtuse angle is between about 110° to 145° e.g. 135°.

It has been found that such rails provide additional benefits compared with 'T'-shaped rails in that they are both easier to manufacture and mechanically stronger in use in a furnace or kiln.

The portion of the rails comprising shoulders for restraining the inner lining may extend, in use in a furnace or kiln, beyond the inner lining per se, and the front of the shoulders may have at least one recess into which ceramic rods or the like may be located to allow electrical heating elements connected thereto and supported thereby to be spaced away from the refractory, heat-insulating inner lining material. This feature is particularly beneficial in the case of electrically heated furnaces or kilns which are heated to temperatures in excess of 1100° C. In respect of furnaces or kilns heated to temperatures below 1100° C. it has been found adequate to support the electrical resistance heating element by partially embedding the element in a surface of the lining.

In another embodiment the rails of the present invention may have additional shoulders, behind the shoulders of head portion specifically to support a backing insulation layer behind the inner lining. In the case of a wall lining the rails are preferably used generally upright.

Figure 5:
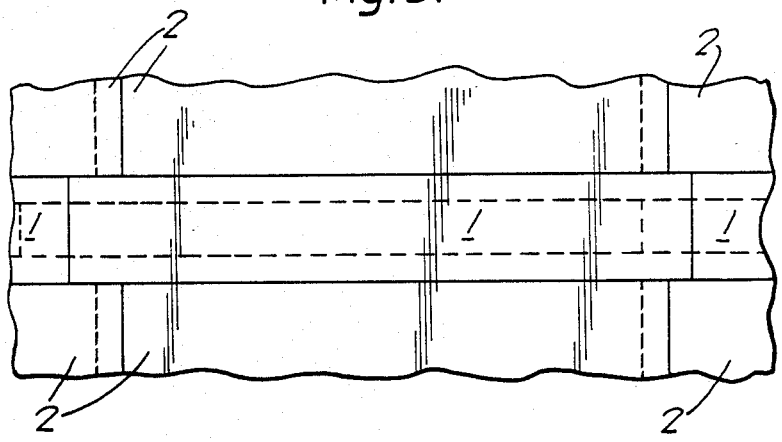
Figure 6:
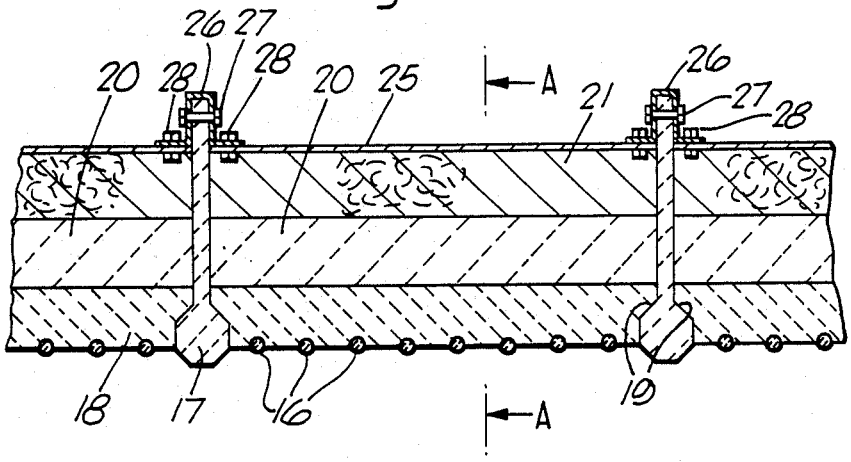
Figure 7:
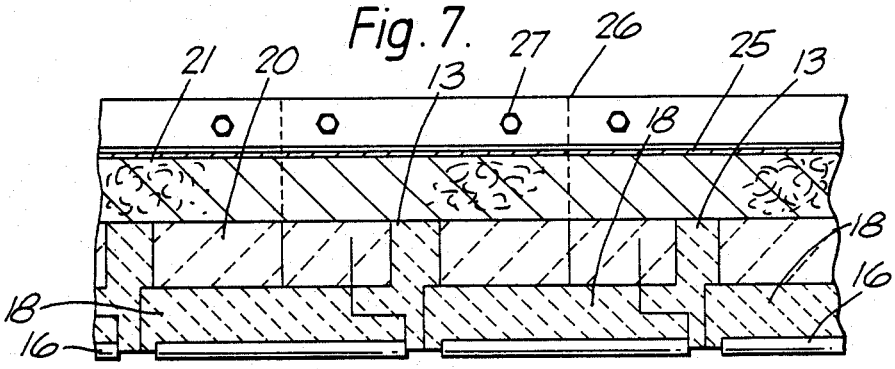
Figure 8:
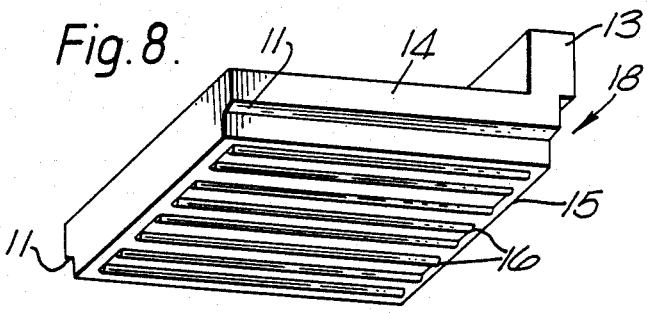

The invention is further described with reference to the accompanying drawings in which:

FIG. 1 is a section through part of a gas-fired furnace roof lined with boards of refractory, heat-insulating material supported by rails in accordance with one embodiment of the invention, FIG. 2 is a view of one of the rails in FIG. 1, FIG. 3 is a view of one of the boards in FIG. 1, FIG. 4 is a view on A—A in FIG. 1, FIG. 5 is a view in the direction of the arrow B in FIG. 1, FIG. 6 is a section through part of an electrically-heated furnace roof lined in accordance with another embodiment of the invention in which rails having bevelled shoulders support the lining boards, FIG. 7 is a view on A—A in FIG. 6, FIG. 8 is a view of one of the boards in FIGS. 6 and 7, FIG. 9 is a section through part of an electrically-heated furnace roof lined in accordance with another embodiment of the invention in which rails having bevelled shoulders support the lining boards, FIG. 10 is a view on A—A in FIG. 9 and FIG. 11 is a view of one of the boards in FIGS. 9 and 10.

Referring to FIGS. 1 to 5 the furnace roof has rails 1 of refractory, heat-insulating material supporting boards 2 of refractory, heat-insulating material. Above the boards 2 are boards 3 of heat-insulating material of lesser refractories than the material of the rails 1 and boards 2. Above the boards 3 is a layer 4 of loose, partly compressed ceramic fibres. Above the layer 4 is a backing plate 5 e.g. of steel. Inverted channels 6 e.g. of steel are attached to the plate 5 by bolts 8. Passing through holes in the channels and in the upper part of the rails are bolts 7 which hold the rails in place and thus also the boards 2 and 3 and the layer 4. The fact that the boards 2 have lapped edges as seen best in FIG. 3 reduces the risk of heat loss at joints and is particularly useful for this reason after any shrinkage of the boards has occurred during use. The lapped edges also enables a lining having a generally flat inner surface to be achieved.

Referring to FIGS. 6 to 8 an electrically heated furnace roof has an electrical heating element 16. Rails 17 of refractory, heat-insulating material support boards 18 also formed of refractory heat-insulating material. The boards 18 are of the type shown in more detail in FIG. 8. The rails 17 have bevelled shoulders 19 which engage with correspondingly bevelled edges formed in the boards 18. Above the boards 18 are boards 20 of heat-insulating material of lesser refractoriness than the material of the rails 17 and boards 18. Above the boards 20 is a layer 21 of loosely compressed ceramic fibre. Above the layer 21 is a backing plate 25 of steel. Inverted channels 26 also of steel are attached to the plate 25 by bolts 28. Passing through holes in the channels and the rails are bolts 27 which hold the rails in place and thus also the boards 28 and 20 and the layer 21. FIG. 8 is a more detailed view of a refractory, heat-insulating board 18 showing the bevelled lapping edges 11. The boards 18 have a rib 13 extending along an edge of the rear face 14. The front face 15 has an electrical resistance heating element 16 partially embedded therein. The rib 13 as shown in FIG. 7 enables each board 18 to be located at the correct distance away from layer 21 which in turn facilitates the making of the connections associated with the electrical heating element.

Referring to FIGS. 9 to 11 the roof of a high temperature electrically heated furnace is constructed substantially as described with reference to the furnace roof in FIGS. 6 and 7 except that the inner lining boards 29 are of the type shown in FIG. 11. The electrical heating element 30 is supported by ceramic rods 31 held in a recess 32 formed in the head portion of the rails 33.

We claim:

1. A furnace or kiln for the heat treatment of materials or articles, said furnace or kiln having an inner lining comprising boards of refractory, heat-insulating material where said boards are restrained from inward movement by rails of a ceramic fiber-based refractory heat-insulating material having shoulders at their inward side against the back of which shoulders edge portions of said boards rest, the thermal conductivity of said rails being not greater than 0.1 $w.M^{-1}.\ ^{\circ}K^{-1}$ at ambient temperature, the rails having a density within the range of 0.2 to 0.75 $g.cm^{-3}$.

2. A furnace or kiln according to claim 1 wherein the density of the rails is greater than the density of the boards.

3. A furnace or kiln according to claim 1 wherein the boards are formed of a ceramic fibre-based refractory heat-insulating material.

4. A furnace or kiln according to claim 1 wherein the cross-section of the shoulders of the rails is generally 'T' shaped.

5. A furnace or kiln according to claim 1 wherein the shoulders of the rails are bevelled.

6. A furnace or kiln according to claim 1 wherein the front of the shoulders of the rails has at least one recess and located in the at least one recess there is an electrically insulating ceramic rod.

7. A furnace or kiln according to claim 1 wherein the boards comprising the inner lining each have a rib extending along an edge of a major face which rib spaces each board a predetermined and generally constant distance away from that part of the furnace or kiln immediately remote from said rib.

8. A furnace or kiln for the heat-treatment of materials or articles, said furnace or kiln having an inner lining comprising boards of refractory, heat-insulating material wherein said boards are restrained from inward movement by rails of refractory heat-insulating material having shoulders at their inward side, said shoulders each having a front and a back, the front of said shoulders having at least one recess, said at least one recess having an electrically insulating ceramic rod located therein, edge portions of said boards resting against the back of said shoulders.

* * * * *